US011957224B2

(12) United States Patent
Evans

(10) Patent No.: US 11,957,224 B2
(45) Date of Patent: Apr. 16, 2024

(54) HYGIENE BAG

(71) Applicant: Chenavis Evans, Auburn, AL (US)

(72) Inventor: Chenavis Evans, Auburn, AL (US)

( * ) Notice: Subject to any disclaimer, the term of this patent is extended or adjusted under 35 U.S.C. 154(b) by 3 days.

(21) Appl. No.: 17/589,407

(22) Filed: Jan. 31, 2022

(65) Prior Publication Data

US 2022/0240636 A1 Aug. 4, 2022

Related U.S. Application Data

(60) Provisional application No. 63/144,037, filed on Feb. 1, 2021.

(51) Int. Cl.

*A45C 11/00* (2006.01)
*A45C 13/10* (2006.01)
*A45C 13/02* (2006.01)

(52) U.S. Cl.

CPC ..... *A45C 11/00* (2013.01); *A45C 13/103* (2013.01); *A45C 13/1046* (2013.01); *A45C 2013/026* (2013.01); *A45C 2013/1015* (2013.01)

(58) Field of Classification Search

CPC ... A45C 11/00; A45C 13/103; A45C 13/1046; A45C 2013/026; A45C 2013/1015
USPC ..... 206/581
See application file for complete search history.

(56) References Cited

U.S. PATENT DOCUMENTS 5,287,960 A * 2/1994 Kalb ..... A61G 9/00 206/440
5,702,379 A * 12/1997 Preiss ..... A61F 13/84 604/385.13
6,073,772 A * 6/2000 Forbes ..... A45C 13/103 383/61.3
8,840,306 B1 * 9/2014 Poel ..... B65D 33/00 383/105
2003/0136704 A1 * 7/2003 Burgess ..... A61F 13/82 206/440
2006/0045391 A1 * 3/2006 Reglar ..... B65F 1/002 383/42
2006/0233470 A1 * 10/2006 Jacoby ..... B65F 1/0006 206/524.4
2007/0239127 A1 * 10/2007 Bridges ..... A61F 13/5515 604/385.13
2009/0067760 A1 * 3/2009 Shelley ..... B65D 81/28 264/238
2009/0112174 A1 * 4/2009 Drevik ..... A61F 13/84 206/370
2009/0152161 A1 * 6/2009 St. Cyr ..... A45C 11/00 206/581
2010/0061663 A1 * 3/2010 Enlund ..... A61F 13/15699 156/251
2010/0243500 A1 * 9/2010 McConnell ..... A61F 13/55185 206/440
2010/0249742 A1 * 9/2010 McConnell ..... A61F 15/003 206/440
2011/0215025 A1 * 9/2011 Gonzales ..... A45C 11/008 206/581
2011/0229059 A1 * 9/2011 Hanna ..... A61F 13/5512 383/1
2012/0301057 A1 * 11/2012 Conant ..... B65D 31/04 383/42

(Continued)

*Primary Examiner* — Jacob K Ackun

(74) *Attorney, Agent, or Firm* — Gardner IP Law, PC

(57) ABSTRACT

A hygienic receptacle for storing and transporting soiled articles, the hygienic receptacle including odor-neutralizing and/or absorbing material and sealable opening.

6 Claims, 3 Drawing Sheets

(56) References Cited

U.S. PATENT DOCUMENTS

| | | | | |
|---|---|---|---|---|
| 2013/0062246 | A1* | 3/2013 | Staples | A45C 11/008<br>206/581 |
| 2015/0239664 | A1* | 8/2015 | Liistro | B65F 1/1623<br>220/523 |
| 2016/0045380 | A1* | 2/2016 | Cree | A61F 13/5514<br>206/524.2 |
| 2016/0101000 | A1* | 4/2016 | Lopez | B65F 1/0006<br>383/93 |

* cited by examiner

A–A

HYGIENE BAG

BACKGROUND

Accidents happen when they are least expected. For example, a teenager may unexpectedly start her menstrual cycle while enjoying the great outdoors. A young child undergoing potty training may have a mishap without a bathroom or a trash can nearby. An adult suffering from incontinence may have an accident while enjoying company in a public setting. In similar situations such as these, the best solution is to quickly remove and store away any soiled garments and slip into fresh new ones. However, it is neither desirable nor hygienic to store the soiled articles alongside other items one may be carrying with him or her. Indeed, it would be advantageous if the soiled articles could be stored away in a receptacle which can hold the soiled articles securely without contaminating the other items. It is to the provision of such a receptacle in the form of a hygiene bag that the present invention is primarily directed.

SUMMARY OF THE INVENTION

Generally, the present invention comprises a hygienic receptacle for storing soiled, or otherwise unclean, garments and personal items, such as for example used undergarments and dirty toiletries. The hygienic receptacle is configured such that odors and/or other contaminants on the soiled items cannot escape and are confined to the hygienic receptacle.

In one aspect, the present disclosure relates to a hygienic receptacle for storing and transporting soiled garments and/or items. The hygienic receptacle includes a storage compartment defined by inner and outer linings for containing soiled garments. The hygienic receptacle further includes an intermediate lining having an odor-neutralizing agent secured between the inner and outer linings. In example embodiments, the odor-neutralizing agent may be at least one of coffee grounds, baking soda, or charcoal. The odor-neutralizing agent may be embedded in the intermediate liner itself or contained adjacent thereto.

In example embodiments, the hygienic receptacle may further include a resealable opening to seal in any odor or other contaminant from escaping the storage compartment. The resealable opening may include a closure mechanism such as for example a drawstring, zipper and/or hook-and-loop fasteners to further seal the opening.

In example embodiments, the hygienic receptacle may further include a removable insert lining adapted or conformed to the storage compartment.

In example embodiments, the hygienic receptacle may further include clasps or hooks to releasably secure the hygienic receptacle to other items, such as for example other bags or hanging rails/hooks.

In example embodiments, the hygienic receptacle may be a bag. In other example embodiments, the hygienic receptacle may have a tube-like appearance or profile.

In some example embodiments, the hygienic receptacle may more than one storage compartments wherein at least one of the storage compartments comprises a resealable opening, for example, with a drawstring closure and a zipper.

In preferred embodiments, the hygienic receptacle is an odor-neutralizing bag or a pocket including an elastic shell. The elastic shell comprises one or more compartments wherein at least one of the compartments includes a first resealable opening. Preferably, the at least one of the compartments is at least partially defined by an inner lining having odor-neutralizing material.

In some preferred embodiments, the odor-neutralizing bag may comprise a resealable opening to provide access to replace the odor-neutralizing material.

In preferred embodiments, the odor-neutralizing bag also includes at least one clasp, hook, or hook-and-loop fastener to releasably secure the odor-neutralizing bag to other luggage or its environment during storage and/or transport.

In another aspect, the present disclosure relates to an odor-neutralizing bag for storing or transporting soiled garments. The odor-neutralizing bag includes an elastic shell having one or more compartments where at least one of the compartments comprises a first resealable opening and is at least partially defined by an inner lining comprising odor-neutralizing material. In example embodiments, the odor-neutralizing material is at least one of baking soda, charcoal, or coffee grounds. In example embodiments, the elastic shell of the odor-neutralizing bag includes a second resealable opening for providing access to the odor-neutralizing material for replacement. In some example embodiments, the odor-neutralizing bag may also include at least one clasp, hook, or hook-and-loop fastener to releasably secure the odor-neutralizing bag to other luggage and/or its environment during storage or transport.

18. In yet another aspect, the present disclosure is related to a hygienic panel or sheet for wrapping and isolating soiled items. The hygienic panel includes a first lining, a second lining, and an intermediate odor-neutralizing lining between the first and second linings. In example embodiments, the hygienic panel may also include a seal along a top side of the hygienic panel and drawstrings along opposing ends of the hygienic panel.

These and other features and advantages of the present invention will become more apparent upon reading the following specification in conjunction with the accompanying drawing figures.

BRIEF DESCRIPTION OF THE DRAWING FIGURES

DETAILED DESCRIPTION

In general, the hygienic receptacle provides an airtight (or substantially airtight) container or storage device for storing and transporting soiled articles, such as for example, soiled garments and used personal items. In other words, the hygienic receptacle provides an inconspicuous solution for isolating and storing soiled garments and items in emergencies. For example, the hygienic receptacle provides a portable and easily accessible containment solution to hold soiled undergarments temporarily if a woman unexpectedly begins her menstrual cycle while she is out in public. In another example, a young child may have an accident and soil his/her undergarment with no bathroom or trash bins around. In still other examples, a person suffering from incontinence may have a mishap requiring him/her to remove any soiled undergarments. In all of these situations, the hygiene receptacle provides a leak-proof, odor-neutralizing solution to store and transport the soiled garments or items temporarily without worrying about any unpleasant odor or matter escaping the receptacle until its contents can be removed and washed.

The hygienic receptacle also allows its users to carry fresh or washed garments and items to change into or use as needed. For example, the hygienic receptacle can be used to carry fresh clothes into a gym for a workout then be used to store and isolate any dirty or sweaty gym clothes after the workout. In some forms, the hygienic receptacle may include a plurality of compartments or pockets for storing and providing easy access to other personal items, such as for example wet wipes, sanitizers, bandages, and toiletries.

Figure 1:
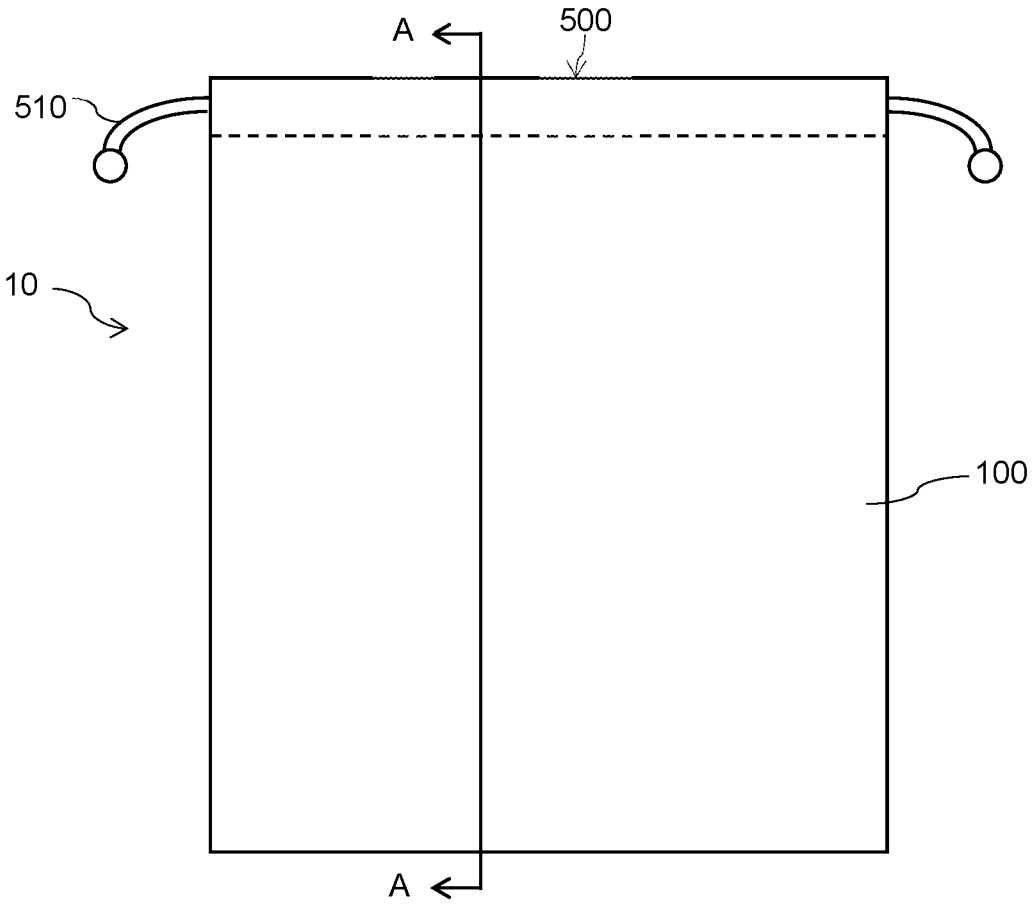
FIG. 1 is a front view of a hygienic receptacle according to a preferred form of the invention.
Figure 2:
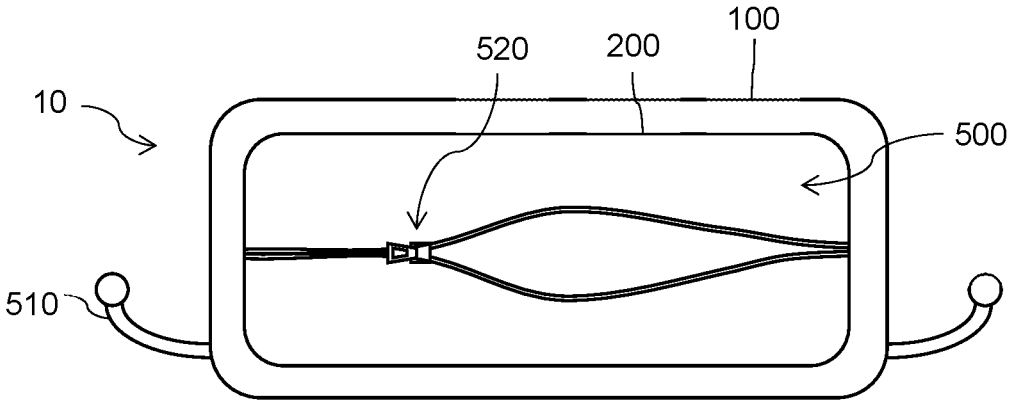
FIG. 2 is top view of the hygienic receptacle of FIG. 1.
Figure 3:
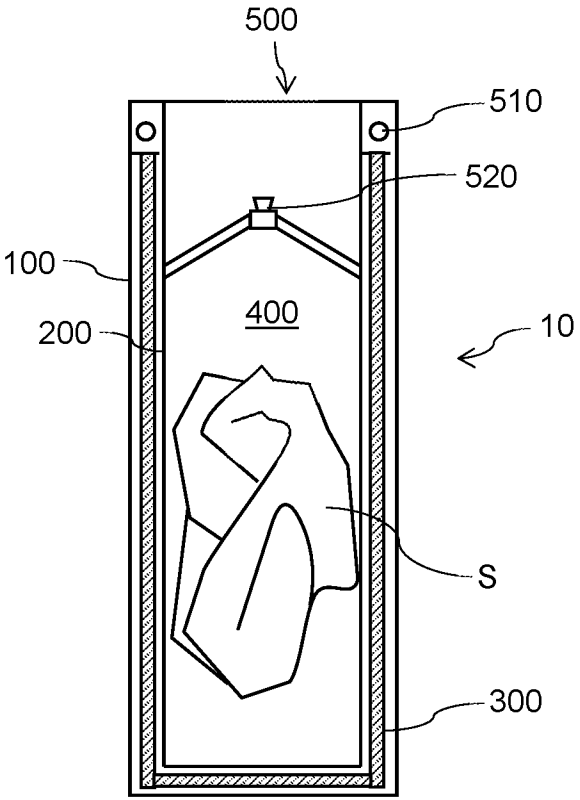
FIG. 3 is a cross-sectional view of the hygienic receptacle of FIG. 1.

Referring now in detail to the drawing figures, wherein like reference numerals represent like parts throughout the several views, FIGS. 1-3 generally show in example form a hygienic receptacle 10 for storing and isolating soiled items, such as for example soiled garments and used sanitary articles. Generally, the hygienic receptacle 10 includes an outer lining or shell 100, an inner lining or shell 200, and an intermediate lining or compartment 300 having odor-neutralizing agents. The inner lining 200 defines an internal volume or storage compartment 400 configured to hold and store items or articles placed therein. Generally, the intermediate lining or compartment 300 is provided between the inner lining 200 and the outer shell 100 and the odor-neutralizing or absorbing material in the lining or compartment provides an odor-neutralizing or absorbing barrier. In other words, the internal storage compartment 400 defined by the inner lining 200 is substantially enveloped or surrounded by the intermediate lining 300 having odor-neutralizing agents and thus prevents substantially any odor from escaping from the internal storage compartment to the surrounding environment through the linings and shells of the hygienic receptacle.

In example forms, the hygienic receptacle further comprises a resealable opening 500 through which items may be placed into and removed from the internal storage compartment 400. Typically, the opening 500 includes one or more reusable or resealable mechanisms, such as for example drawstrings, zippers, and/or hook-and-loop fasteners, to provide a completely (or at least substantially) airtight seal when the opening is closed with the resealable mechanisms are engaged. Therefore, with the odor-neutralizing receptacle linings and the resealable opening, the hygienic receptacle prevents virtually any odor from escaping from inside the receptacle and provides a hygienic means for storing and transporting odorous and/or contaminated items.

Generally, the hygienic receptacle can be made in a variety of sizes and forms. For example, the hygienic receptacle could be small enough to fit into purses or backpacks. Alternatively, the hygienic receptacle could be large enough to hold for example one or two sets of clothing needed while traveling for a day or two. Yet still, the hygienic receptacle could be large enough to fit for example multiple sets of clothing and personal items needed while traveling for an extended period of time.

In preferred example forms, the hygienic receptacle is a bag made from elastic or stretchable materials, such as for example spandex. The hygienic receptacle is preferably configured to take up as little space or volume as possible when it is not in use, but is also able to accommodate and conform to larger items when needed. For example, the hygienic bag may be small enough to be carried in a purse or a backpack when not in use (i.e., when nothing is stored in the hygiene bag). However, the hygienic bag is elastic enough to hold for example two sets of clothes when needed. The bag material is preferably also soft enough to be folded, twisted, and/or rolled up when not in use.

In example forms, the outer and inner linings 100, 200 are made from synthetic fabric, such as for example polyethylene with a blend of bamboo and cotton. The intermediate lining 300 comprises natural and/or synthetic odor-neutralizing and/or odor-absorbing agents, such as for example coffee grounds, baking soda, or charcoal. In preferred example forms, the odor-neutralizing agent is embedded in the intermediate lining itself. In other example forms, an intermediate compartment or space may be provided between the inner and outer linings, the intermediate compartment or space being filled with loose odor-neutralizing agents.

In example forms, the hygienic bag includes a resealable opening 500 with a drawstring closure 510 and a zipper 520. The zipper 520 preferably provides an airtight, or substantially airtight, seal over the internal storage compartment 400. The drawstring closure 510 further improves the hygienic bag's ability to seal in any unpleasant odor from any soiled item placed inside the internal storage compartment. In some example forms, the hygienic bag may comprise a tube-like profile or form and the airtight seal is achieved by twisting the open end of the tube and securing it in its twisted form with a hook, strap, clip or other comparable means. In effect, the tighter the tube is twisted, the tighter the tube is sealed. In another example form, the hygienic bag may comprise a substantially flat profile or form to fit and/or conform to the conventional purses. In still another form, the hygienic bag may comprise an elongated form or profile. In general, those skilled in the art will appreciate the hygienic bag may comprise a variety of shapes, forms and/or profiles.

According to example forms, the hygienic bag may further comprise attachment means to releasably secure the hygienic bag to other items or its environment. For example, the hygienic bag may include snap or hook-and-loop fasteners to releasably attach the hygienic bag to the inside or outside of a purse, backpack, or the like (e.g., a keyring or a net lining inside a backpack or a zipper inside a purse). In another example, the hygiene bag may include clasps, hooks, or other similar mechanical feature to anchor or hang the hygienic bag from, for example, hanging hooks and rails. For example, the hygienic bag may include a clasp or a hook to hang the hygienic bag from, for example, a hanging rail inside locker.

Figure 4:
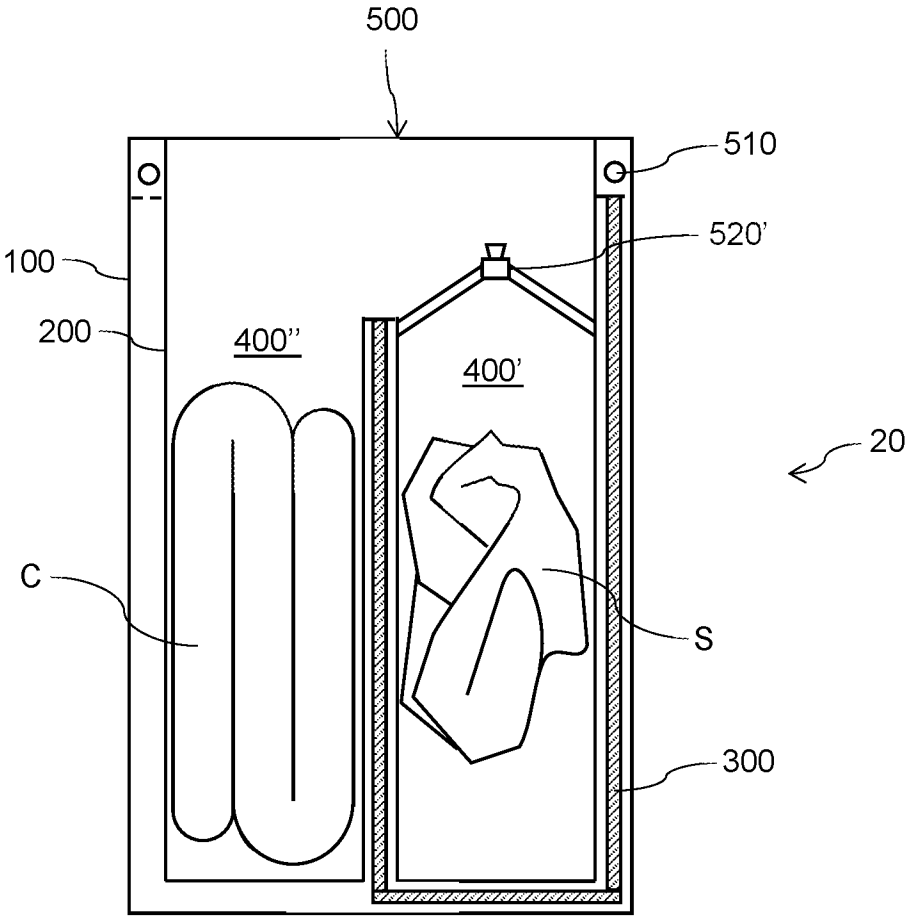
FIG. 4 is a cross-sectional view of another example embodiment of the hygienic receptacle according to another form of the invention.

In some example forms, the hygienic bag may include a plurality of storage compartments for example for storing and transporting both soiled and clean articles, such as for example garments and personal belongings, simultaneously. For example, as shown in FIG. 4, the hygienic bag 20 comprises two storage compartments—a first storage compartment 400' and a second storage compartment 400". In the depicted embodiment, the first storage compartment 400' is configured or adapted for receiving and storing soiled garments S and the second storage compartment 400" is configured or adapted for receiving and storing clean garments C.

For example, the first storage compartment 400' includes a resealable seal for example a zipper to fully enclose the first storage compartment from the rest of the internal volume of the bag. The first storage compartment is further substantially enveloped by intermediate lining 300. Accordingly, the first storage compartment 400' is resealably enclosed by the zipper 520' to isolate the soiled garment S from the rest of the internal volume of the hygienic bag. In other words, the zipper 520' is provided to prevent cross contamination of, for example, odor and/or dirt between soiled and clean articles S, C stored in the first and second compartments 400', 400".

In still other example forms, the hygienic bag may comprise more than two internal storage compartments. In example forms where more than one internal storage compartments are provided, the storage compartments may be of the same size and/or of different sizes. In some example forms, the hygienic bag may further comprise one or more smaller pockets secured thereto for storing smaller items, such as, for example, sanitary products, cosmetic products, first-aid items, credit cards, ID's, pens, etc. The smaller pockets may be provided on the outer shell or inner lining.

In example forms of use, the hygienic bag provides a sanitary and hygienic solution for storing and transporting contaminated or otherwise soiled articles and items, such as for example soiled garments, used toiletries, and dirty personal belongings. For example, the hygienic receptacle includes odor-neutralizing/absorbing material embedded or stored between the receptacle linings and a manually operable seal to neutralize unpleasant/foul odors from the soiled articles and prevent such odor from emanating to its surrounding or environment. For example, if a user is accidentally soils his/her undergarments while out in public, the user is able to quickly open the drawstring and zipper seals, place the soiled garments into the storage compartment, reseal the zipper and drawstring closures. If the hygienic receptacle includes additional compartments, the user may further carry clean garments to change into when needed.

Figure 6:
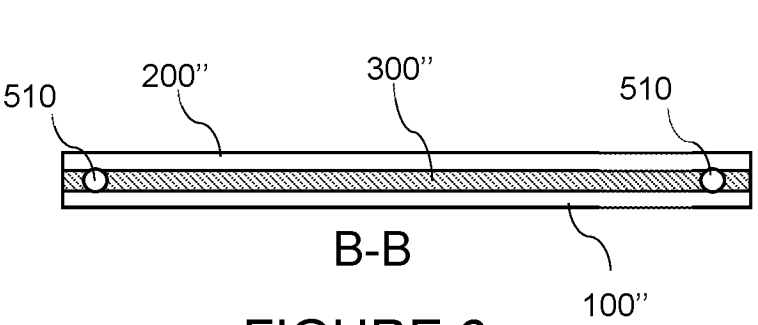
FIG. 6 is top view of the hygienic receptacle of FIG. 5.
Figure 7:
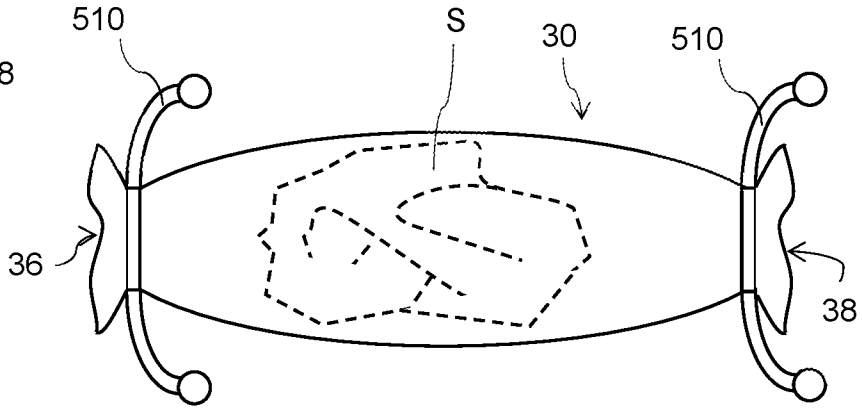
FIG. 7 is a cross-sectional view of the hygienic receptacle of FIG. 5.
Figure 5:
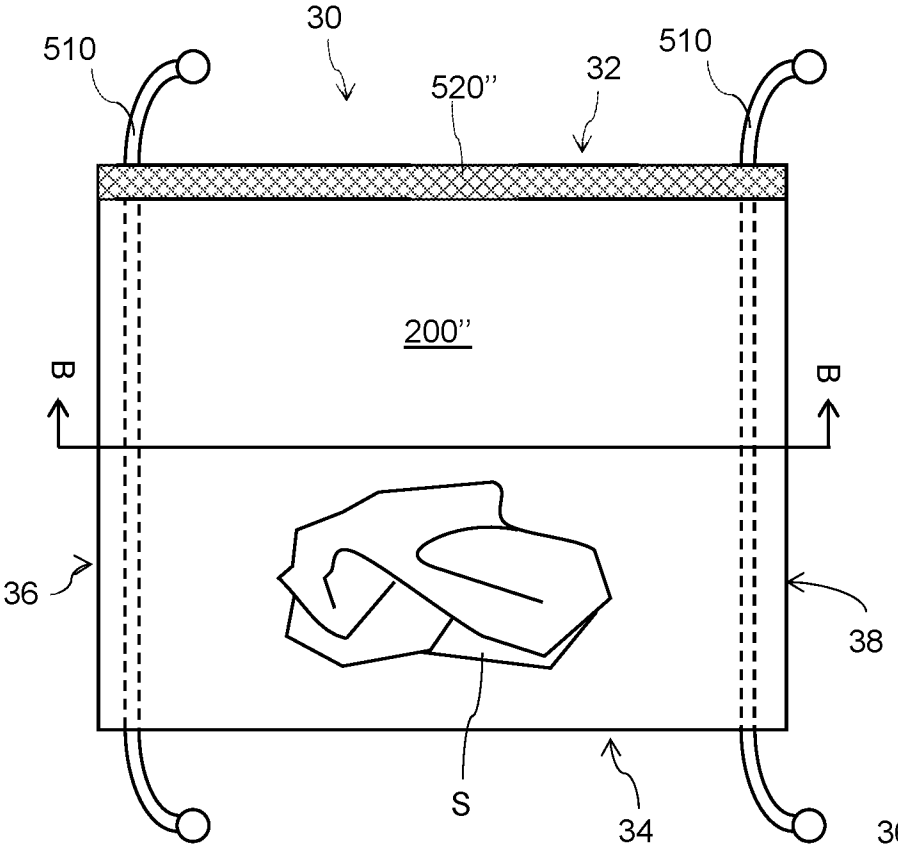
FIG. 5 is a front view of a hygienic receptacle in another example form.

In other example forms, the hygiene receptacle is provided in the form of a fabric wrap or panel which can be rolled or wrapped over a soiled item and sealed using one or more resealing mechanisms. FIGS. 5-7 show, for example, a hygienic panel 30 which is flexible enough to be rolled or folded as needed. The hygienic panel 30 includes a first outer lining 100", a second inner lining 200", and a third intermediate lining 300" secured between the outer and inner linings. In preferred example forms, the intermediate lining 300" includes or is embedded with odor-neutralizing or odor-absorbing agents or materials. Alternatively, an accessible cavity or pocket may be provided between the inner and outer linings, the cavity being accessible via a resealable opening on the panel and configured to accept disposable odor-neutralizing sheets, packets, loose material, etc.

In preferred example forms, the hygienic panel 30 has a first, top side 32 and a second, bottom side 34 opposite the first side, the first and second sides defining a width of the panel. The panel also has a first end 36 and second end 38 opposite the first end, the first and second ends defining a length of the panel. The length and width define a surface area of the hygienic panel 30. As shown in FIG. 5, drawstrings 510 are operably provided along the first and second ends of the panel and a seal 520" is provided along the first, top side of the panel on the inner lining 200". In preferred example forms, the seal 520" is a first half portion (e.g., the hook half) of a hook-and-loop fastener. The second half portion (e.g., the loop portion) is provided on the outer lining 100" for cooperative engagement with the first half portion when the panel is for example rolled over the soiled item.

Generally, the hygienic panel 30 is used to contain and isolate soiled garments and/or items S from its environment and keep any odor and/or contaminant from spreading therefrom. In preferred modes of use, the hygienic panel is first provided on a support surface with the inner lining facing up or away from the support surface. A soiled item S is then placed on the inner lining 200" preferably near or adjacent the bottom side of the panel. To wrap the soiled item S in the panel, the bottom side of the panel is worked over the soiled item and continuously rolled back towards the inner lining. Preferably, the panel is rolled tightly to ensure the soiled item does not move about inside the rolled panel.

Once the rolled portion of the panel reaches the free top side of the panel, the hook portion of hook-and-loop fastener 520" engages the corresponding loop portion of the hook-and-loop fastener positioned along the outer lining 100". Preferably, the two portions of the hook-and-loop seal are aligned so as to create a substantially airtight seal along the entire length of the rolled panel 30. As shown in FIG. 7, the first and seconds ends 36, 38 of the now rolled hygienic panel 30 are closed or sealed by tightening the drawstrings 510 around the first and second ends. The loose or left over material on the first and second ends can further be pushed or tucked into the drawstring or closed ends to ensure a greater seal.

Preferably, the hygienic panel is sufficiently large to wrap therein one or more sets of clothing. However, the hygienic panels can be smaller or larger to accommodate smaller or larger items.

Preferably, the hygienic panel 30 is made from elastic or stretchable materials, such as for example spandex, which allows the hygienic panel to conform to the item being wrapped therein and minimize the overall shape and size of the hygiene panel in use. When the hygienic panel 30 is not in use, the panel lays flat so it can be folded neatly and compactly for easy and convenient storage. For example, the hygienic panel may be small enough when folded to be carried in a purse or a backpack. Alternatively, the hygienic panel may be larger to accommodate larger or more items. For example, the hygienic panel may be large enough to wrap therein multiple sets of dirty clothing for example from a multi-day trip and keep the dirty clothes isolated from other items in the suitcase.

In some example forms, the hygienic panel may further include one or more pockets or compartments secured to the inner and/or outer linings for storing additional items, such as for example small undergarments.

In some example forms, the hygienic receptacle may be washable or disposable. In disposable forms, the hygienic receptacles may be provided with pre-applied adhesives or glues in place of other sealing mechanisms disclosed herein.

In some example forms, the hygienic receptacle may further comprise logos, designs, and/or decorative features.

In still other example forms, the odor-neutralizing material may be provided as replaceable or refill packs which can be inserted between the inner and outer linings via a resealable opening on the inner or outer linings. In other example forms, the odor-neutralizing material may be provided as loose grains or other suitable forms of odor-neutralizing material which can be used to fill the intermediate space between the outer and inner linings via a resealable opening provided on the hygienic bag.

While the invention has been disclosed in preferred forms, it will be apparent to those skilled in the art that many modifications, additions, and deletions may be made therein without departing from the spirit and scope of the invention as set forth in the following Claims.

What is claimed is:

1. A hygienic receptacle for storing soiled garments, the hygienic receptacle comprising:

an outer lining;

an inner lining defining a first storage compartment;

an intermediate lining secured between the inner and outer linings;

a resealable opening with a drawstring closure and a zipper; and an odor-neutralizing agent adjacent or in the intermediate lining.

2. The hygienic receptacle of claim 1, wherein at least one of the inner lining or outer lining comprises elastic material.

3. The hygienic receptacle of claim 2, wherein the elastic material comprises spandex.

4. The hygienic receptacle of claim 1, the hygienic receptacle comprising fabric including bamboo and cotton.

5. The hygienic receptacle of claim 1, wherein the odor-neutralizing agent comprises at least one of coffee grounds, baking soda, or charcoal.

6. The hygienic receptacle of claim 1, wherein the hygienic receptacle is a bag.

* * * * *